US011462849B2

(12) United States Patent
Cain et al.

(10) Patent No.: US 11,462,849 B2
(45) Date of Patent: Oct. 4, 2022

(54) POWER CONNECTOR FOR ELECTRICAL SUBMERSIBLE PUMP

(71) Applicant: Baker Hughes Oilfield Operations LLC, Houston, TX (US)

(72) Inventors: Sean Cain, Tulsa, OK (US); Scott Strattan, Tulsa, OK (US); Sarah Smith, Claremore, OK (US); Chad Craig, Tulsa, OK (US)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 0 days.

(21) Appl. No.: 17/217,092

(22) Filed: Mar. 30, 2021

(65) Prior Publication Data

US 2021/0305742 A1 Sep. 30, 2021

Related U.S. Application Data

(60) Provisional application No. 63/002,677, filed on Mar. 31, 2020.

(51) Int. Cl.
*H01R 13/11* (2006.01)
*H01R 13/52* (2006.01)
(Continued)

(52) U.S. Cl.
CPC ..... *H01R 13/111* (2013.01); *H01R 11/09* (2013.01); *H01R 13/187* (2013.01); *H01R 13/5205* (2013.01)

(58) Field of Classification Search
CPC ..... H01R 13/187
See application file for complete search history.

(56) References Cited

U.S. PATENT DOCUMENTS 2,648,883 A * 8/1953 Dupre ..... H01R 4/50 403/314
4,299,363 A 11/1981 Datschefski
(Continued)

FOREIGN PATENT DOCUMENTS

CN 206432688 U 8/2017
CN 209822928 U 12/2019
WO 2016135170 A1 9/2016

OTHER PUBLICATIONS

International Search Report and Written Opinion of PCT Application No. PCT/US2021/070342 dated Jul. 13, 2021: pp. 1-11.

*Primary Examiner* — Ross N Gushi
(74) *Attorney, Agent, or Firm* — Bracewell LLP; Constance G. Rhebergen; Keith R. Derrington

(57) ABSTRACT

An electrical connector having an electrical conductor member with a first opening and a second opening. Grab rings mounted in the openings have inner diameters containing teeth with crests defining a superimposed inner diameter. The teeth of the grab rings deflect and frictionally engage the outer diameter of the wires to retain them in the openings. A sleeve of insulation material covers an exterior of the conductor member. The sleeve has ends that protrude past the openings and receive an insulation layer of the wires. Resilient electrical contact members are recessed from the grab rings in the openings. The electrical contact members have inner portions biased into contact with the electrical wires and outer portions biased into contact with the conductor member.

20 Claims, 5 Drawing Sheets

(51) Int. Cl.
*H01R 13/187* (2006.01)
*H01R 11/09* (2006.01)

(56) References Cited

U.S. PATENT DOCUMENTS

| | | | | |
|---|---|---|---|---|
| 4,722,579 | A * | 2/1988 | Cummings ..... | H01R 4/2404 439/441 |
| 8,382,508 | B1 | 2/2013 | Frey et al. | |
| 10,443,317 | B2 | 10/2019 | O'Grady et al. | |
| 10,916,892 | B2 | 2/2021 | Nolting et al. | |
| 2010/0291782 | A1 | 11/2010 | Made et al. | |

* cited by examiner

POWER CONNECTOR FOR ELECTRICAL SUBMERSIBLE PUMP

CROSS REFERENCE TO RELATED APPLICATION

This application claims priority to provisional application Ser. No. 63/002,677, filed Mar. 31, 2020.

FIELD OF THE DISCLOSURE

This disclosure relates in general to electrical submersible well pumps (ESP), particularly to an electrical power connector for the ESP.

BACKGROUND

ESPs are often used to pump well fluid from hydrocarbon producing wells. A typical ESP for a hydrocarbon producing well has a pump driven by a three-phase electrical motor. The motor may be an inductive type, or it may be a permanent magnet motor.

A power cable extends from a wellhead to the motor to supply power. The power cable has three insulated electrical conductors, one for each phase. One type of power cable is round, with the three electrical conductors spaced 120 degrees apart from each other. Another type of power cable is flat, having the three conductors located side-by-side.

In some instances a splice may be made in the power cable to lengthen the power cable. Also, in the case of flat power cable, transpositional splices may be made at various points along the length of the power cable to correct for a voltage imbalance. For example, power conductors leading to phase A and phase C windings in the motor in a lower length of the power cable may be on right and left outer side edges of the flat power cable. The power conductor in the lower length of the power cable leading to phase B windings may be in a center position between the phase A and phase C. A transpositional splice may be made thousands of feet from the motor to connect the phase A conductor in the lower length of the power cable to a middle position in a next upward length of the power cable. Also, in that transpositional splice, the phase C conductor in the lower power cable length may connect to the left outer side of the next upward length of the power cable. The phase B conductor in the lower power cable length may connect to the right outer side of the next upward length of the power cable.

A splice may also be required between the power cable and a motor lead extension. In addition, other conductor-to-conductor connections are made in ESP installations. As an example, connections for the power conductors may be required for electrical penetrators extending through packers. Electrical connections are required between the windings within the motor and flex wires, and between the flex wires and motor lead extension wires.

In some instances these electrical connections must be made after the ESP is partially or entirely lowered into the well. Special care must be taken when making an electrical power connection for a permanent magnet motor because if the rotor of the motor is rotated, it can generate a significant electrical charge that could be harmful to the technician making the electrical connection. A variety of electrical connections are known, however, improvements are desired.

SUMMARY

An electrical connector comprises an electrical conductor member having a longitudinal axis, a first end with a first opening and a second end with a second opening. First and second grab rings mounted in the first and second openings have inner diameters containing a plurality of teeth protruding toward the axis. The teeth have crests defining a superimposed inner diameter for each of the grab rings. The superimposed inner diameter of the first grab ring is selected to receive a first electrical wire having a larger outer diameter than the superimposed inner diameter of the first grab ring, causing the teeth of the first grab ring to deflect and frictionally engage the outer diameter of the first wire to retain the first wire in the first opening. The superimposed inner diameter of the second grab ring is selected to receive a second electrical wire having a larger outer diameter than the superimposed inner diameter of the second grab ring, causing the teeth of the second grab ring to deflect and frictionally engage the outer diameter of the second wire to retain the second wire in the second opening.

A sleeve of insulation material covers an exterior of the conductor member. The sleeve may have a first end that protrudes past the first opening of the conductor member to closely receive the sleeve of the first wire. The sleeve may have a second end that protrudes past the second opening of the conductor member to receive an insulation layer of the second wire.

A resilient first electrical contact member is in the first opening adjacent the first grab ring. The first electrical contact member has an inner portion sized to be biased into contact with the first electrical wire and an outer portion biased into contact with the conductor member. A resilient second electrical contact member is in the second opening adjacent the second grab ring. The second electrical contact member has an inner portion sized to be biased into contact with the second electrical wire and an outer portion biased into contact with the conductor member. Each of the grab rings may be in electrical contact with the conductor member.

The crest of each of the teeth of each of the grab rings has a curvature with a radius extending from the axis that is equal to a radius of the superimposed inner diameter.

Each of the grab rings comprises a circular rim having an outer surface that defines the outer diameter of each of the grab rings. The rim of each of the grab rings has an inner diameter. Each of the teeth of each of the grab rings has an outer portion joining the inner diameter of the rim.

In the embodiment shown, the teeth of each of the grab rings define a superimposed conical surface of revolution. The rim of each of the grab rings is located in a plane perpendicular to the axis.

In the embodiment shown, the crest of each of the teeth has a curvature with a radius that defines the superimposed inner diameter. The crest of each of the teeth has a circumferentially extending dimension. The outer portion of each of the teeth of each of the grab rings has a circumferentially extending dimension that is less than the circumferentially extending dimension of each of the crests.

DETAILED DESCRIPTION OF THE DISCLOSURE

Figure 1:
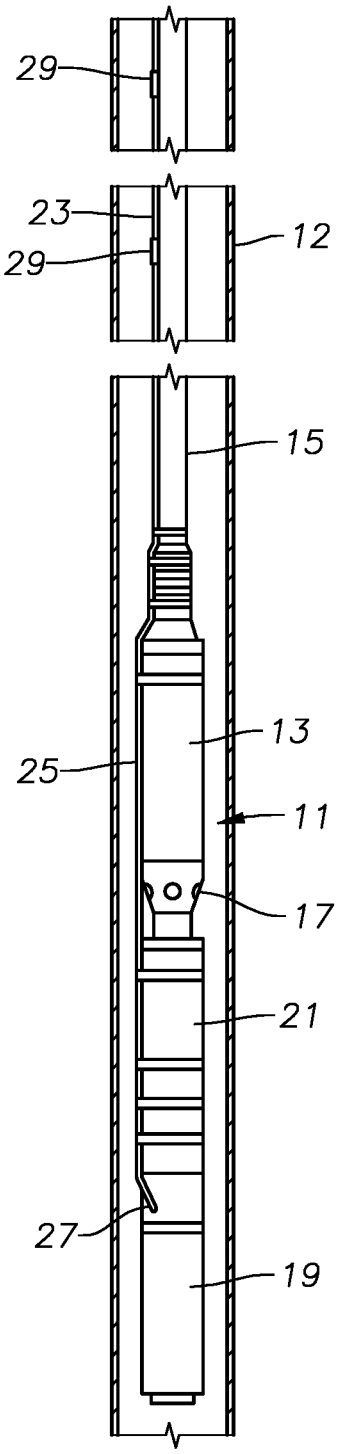
FIG. 1 is a schematic side view of an electrical submersible pump assembly having a power connection in accordance with this disclosure.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper" and "lower" and the like are used only for convenience as the well pump may operate in positions other than vertical, including in horizontal sections of a well.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates an electrical well pump assembly (ESP) 11 of a type typically used for oil well pumping operations and shown installed in well casing 12. ESP 11 includes a pump 13, which may be a centrifugal pump having a large number of stages, each of the stages having an impeller and a diffuser. Pump 13 could alternately be other types, such a progressive cavity, or positive displacement. Pump 13 may be suspended in a well on a string of production tubing 15. Pump 13 has an intake 17 and discharges into production tubing 15.

ESP 11 also includes an electrical motor 19 for driving pump 13. Motor 19 connects to pump 13 via a seal section 21. Motor 19 is filled with a dielectric lubricant, and a pressure equalizer reduces a pressure differential between the dielectric lubricant and the well fluid on the exterior. The pressure equalizer may be within seal section 21 or in a separate module. Intake 17 may be at the lower end of pump 13, in the upper end of seal section 21, or in a separate module. Also, ESP 11 may also include a gas separator, and if so, intake 17 would be in the gas separator.

A power cable 23 is strapped to and extends alongside tubing 15 from a power source at the wellhead. Power cable 23 joins a motor lead extension 25 that extends along ESP 11. Motor lead extension 25 has a plug 27 on its lower end that connects to motor 19. Motor lead extension 25 may have a flat configuration with three power conductors, or it could be comprised of three separate tubes, each having one of the power conductors.

Figure 2:
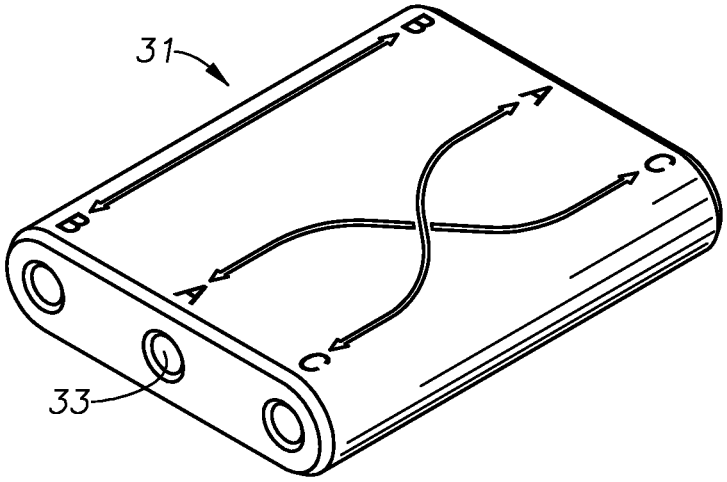
FIG. 2 is a perspective view of device for making a transpositional splice in the power cable of the assembly of FIG. 1, schematically illustrating a splice.

In this example, power cable 23 is in a flat configuration and has transpositional splices 29 (two illustrated) to correct for voltage imbalance. FIG. 2 illustrates an electrical connector 31 for making one of the transpositional splices 29, and the other ones will be similar. A lower length of power cable 23 extends upward from motor lead extension 25 (FIG. 1). Power cable 23 has a flat configuration with three insulated conductors wrapped in a metal armor. Each insulated conductor is electrically connected to one of the phase windings in motor 19 (FIG. 1), labelled A, B and C on electrical connector 31. Electrical connector 31 has three openings 33 in each end. Each opening receives one of the insulated conductors of power cable 23.

As an example only, electrical connector 31 will change the position of the conductor for phase A from a right-hand side position (as shown in the drawings) in power cable 23 to a central position in the next portion of power cable 23. Electrical connector 31 will change the position for the conductor of phase C from a central position to a right-hand side in the next portion of power cable 23. Electrical connector 31 keeps the conductor for phase B on the left-hand side of power cable 23.

Figure 3:
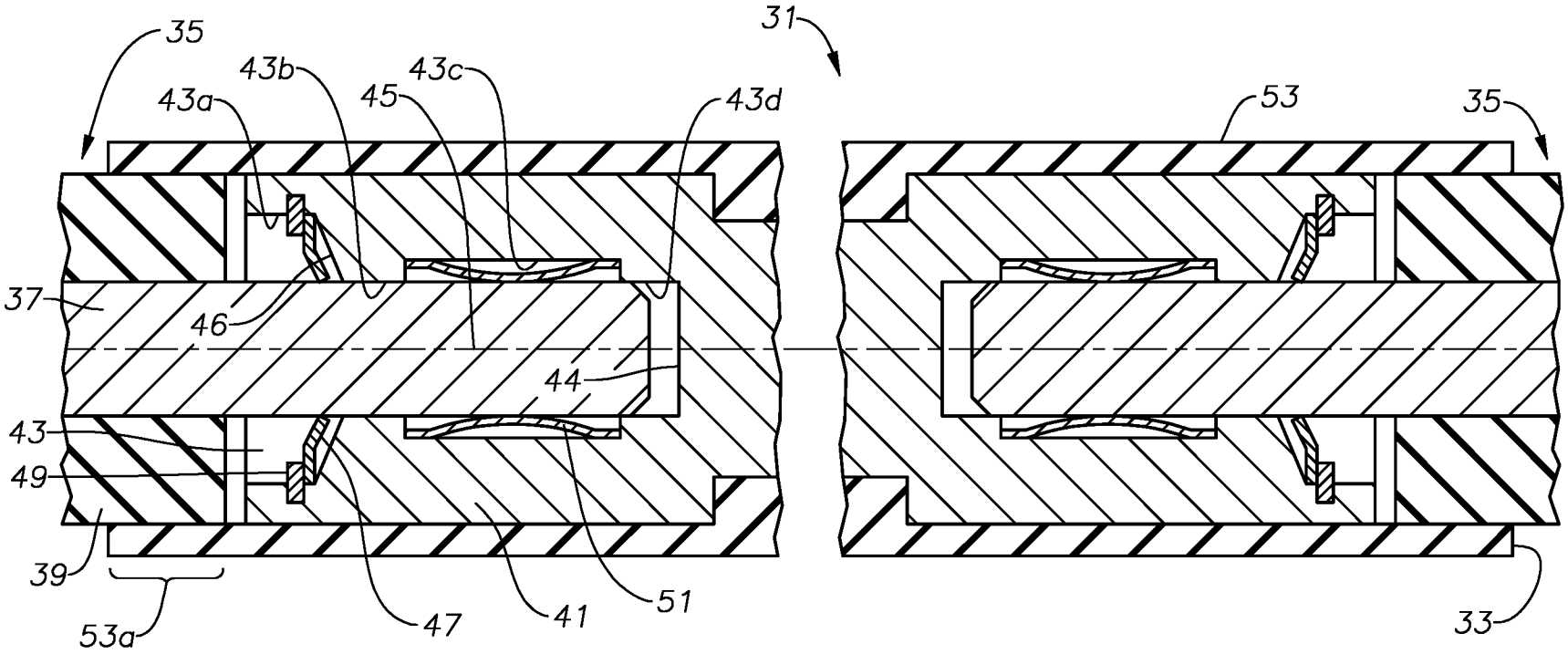
FIG. 3 is an enlarged sectional view of one of the electrical connectors of the splice of FIG. 2, taken along the line 3-3 of FIG. 2.

FIG. 3 illustrates one of the connectors of electrical connector 31, which joins one of the insulated conductors 35 of one length of power cable 23 to another insulated conductor 35 of the next length of power cable 23. The other two electrical connectors of electrical connector 31 will be the same. Insulated conductors 35 each have an electrical conductor or copper wire 37 encased in one or more layers of insulation 39. Copper wire 37 may be solid or stranded. In this example, insulation layer 39 will be stripped back so that an exposed end of copper wire 37 protrudes from an end of insulation layer 39.

Electrical connector 31 has a conductor member 41 of an electrical conductive metal such as copper. Conductor member 41 is a cylindrical rod with an opening or bore 43 on each end. Bores 43 could join each other or be separated as shown. A longitudinal axis 45 of conductor member 41 passes through each bore 43. In this embodiment, each bore 43 has an entry section 43*a*, an intermediate section 43*b*, a contact member section 43*c* and a recessed end section 43*d*. Entry section 43*a* has a larger inner diameter than intermediate section 43*b* and contact member section 43*c*. An outward facing conical wall 46 is located at the recessed end of the entry section 43*a*. Intermediate section 43*b* and recessed end section 43*d* have smaller inner diameters than contact member section 43*c*. The recessed end of recessed end section 43*d* may be closed with an outward facing wall 44. A longitudinal axis 45 of conductor member 41 extends coaxially through bores 43. Entry section 43*d* has a conical wall 46 that inclines to a smaller diameter in a recessed direction toward recessed end section 43*d*.

In this example, a gripping device, referred to herein as grab ring 47, fits within bore entry section 43*a* outward from conical wall 46. A snap or retaining ring 49 fits within a groove outward of grab ring 47 to retain grab ring 47 in bore entry section 43*a*. Snap ring 49 and conical wall 46 prevent grab ring 47 from sliding axially relative to conductor member 41. Grab ring 47 engages and grips wire 37 as wire 37 is pushed into bore entry section 43*a*, preventing wire 37 from easily being withdrawn. Grab ring 47 may also provide electrical continuity between wire 37 and conductor member 41 in the embodiment shown.

An optional electrical contact member 51 fits within bore contact member section 43*c*, which is cylindrical. Contact member 51 has an outward end that abuts an inward facing shoulder of bore contact member section 43*c*. Contact member 51 has a recessed end that abuts an outward facing shoulder at the outward end of bore contact member section 43*c*, preventing contact member 51 from axial movement. Electrical contact member 51 is formed of a conductive material, such as copper, and has a central inner portion that is in biased engagement with wire 37 and an outer portion that is biased into engagement with the outer diameter of contact member section 43*c*. Once wire 37 is pushed into electrical contact member 51, it will provides electrical continuity between wire 37 and conductor member 41.

Conductor member 41 may also have an electrical insulation sleeve 53 on its exterior. Insulation sleeve 53 may cover all three of the electrical connectors of the transpositional splice connector 31 of FIG. 2. In the embodiments shown, insulation sleeve 53 protrudes past each end of conductor member 41, resulting in a protruding portion 53*a* on each end. Insulation layer 39 slides into the protruding portion 53*a* as wire 37 is inserted into bore 43. The length of protruding portion 53*a* may be selected such that wire 37 will be substantially obscured by protruding portion 53*a* before it contacts grab ring 47 or contact member 51. Tape (not shown) may be wrapped around the junction of each end of insulation sleeve 53 and insulation layer 39 to seal each bore 43.

Figure 5:
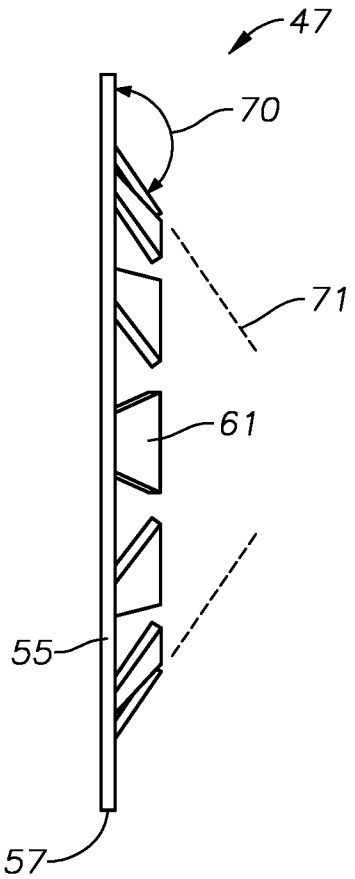
FIG. 5 is a side view of the grab ring of FIG. 4.
Figure 4:
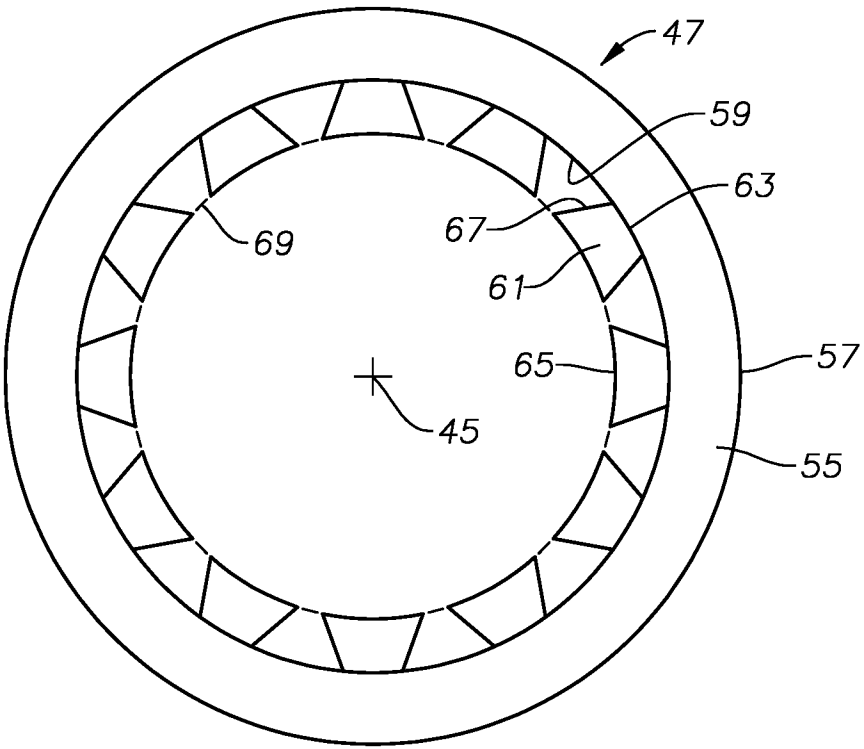
FIG. 4 is a front view of one of the grab rings of the connector of FIG. 3, shown removed from the connector.
Figure 6:
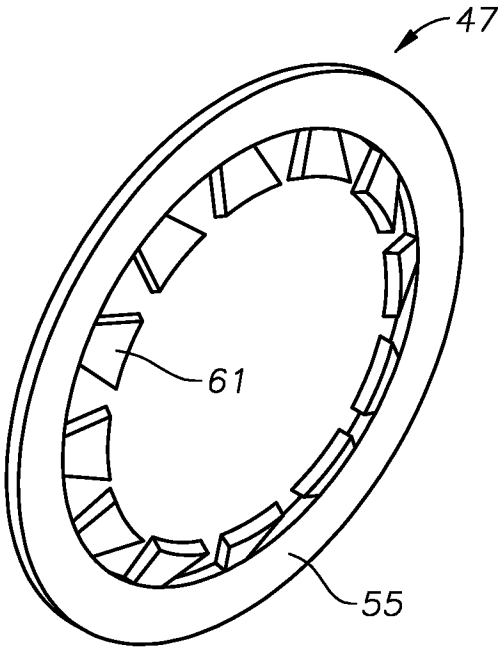
FIG. 6 is a perspective view of the grab ring of FIG. 4.

Grab ring 47 may have a variety of configurations. In the embodiment of FIGS. 4-6, grab ring 47 has an annular or circular rim 55 that is flat and located in a plane perpendicular to axis 45. Rim 55 has an outer diameter 57 that is in close contact with or touching the outer diameter of bore entry portion 43*a*. Rim 55 has an inner diameter 59 with a plurality of teeth 61 protruding toward axis 45. Each tooth 61 has an outer portion 63 that may be integrally formed with rim 55. That is, teeth 61 and rim 55 may be formed of a single monolithic piece of material, such as metal. Each tooth 61 has an inner portion or crest 65 joined to outer portion 63 by flanks 67. In this example, crests 65 are curved, providing a superimposed inner diameter 69 for grab ring 47. A radius of each crest 65 from axis 45 defines the superimposed inner diameter 69. Superimposed inner diameter 69 is initially slightly less than the outer diameter of wire 37 so as to cause teeth 61 to elastically deflect and grip wire 37 as it is pushed into grab ring 47.

Each crest 65 is a portion of a circle. Crests 65 have a greater circumferential dimension between flanks 67 than teeth outer portions 63 between flanks 67. Flanks 67 of each tooth 61 diverge from each other from outer portion 63 to crest 65. Teeth 61 are equally spaced apart from each other. As shown in FIG. 5, teeth 61 are manufactured to be at a conical angle 70 relative to rim 55. Conical angle 70 results in teeth 61 being located on a conical surface of revolution 71. Conical wall 46 (FIG. 3) is at the same angle of inclination as conical angle 70. Teeth 61 can deflect flush against conical wall 46 when wire 37 is be forced into grab ring 47.

Teeth 61 thus protrude in an inward direction inclining toward the wall that separates bore entry portion 43*a* from bore intermediate portion 43*b*. The inward inclination allows wire 37 (FIG. 3) to be readily pushed through grab ring 47 but prevents withdrawal of wire 37 without excessive force. Grab ring 47 may be formed of a conductive metal. If so, electrical continuity may be provided by grab ring 47 between wire 37 and conductor member 41 (FIG. 3).

Figure 7:
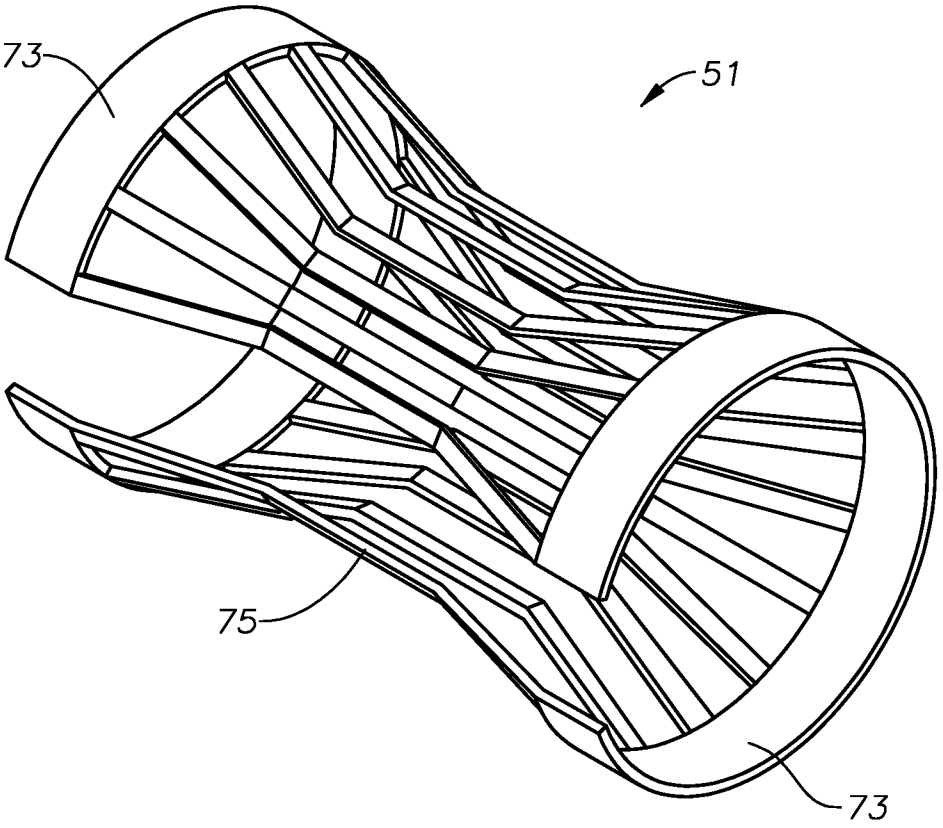
FIG. 7 is a perspective view one of the contact bands of the connector of FIG. 3, shown removed from the connector.

Electrical contact member 51 may be of various configurations to establish continuity between wire 37 and conductor member 41. As shown in FIG. 7, electrical contact member 51 may have two partly cylindrical ends 73 connected by spaced-apart bands 75. Ends 73 may be completely cylindrical, or they may be split as shown so as to be biased into contact with conductor member contact member bore section 43*c*. Ends 73 will be in tight engagement with conductor member 41 in contact member bore section 43*c*. Bands 75 are spaced evenly apart from each other and curve toward axis 45 (FIG. 3). The curvature of bands 75 results in an inner diameter at a midpoint between ends 73 that is initially smaller than the outer diameter of wire 37. When a technician pushes wire 37 into contact member 51, bands 75 engage wire 37 and elastically deflect, biasing contact member 51 into tight contact with wire 37. The initial inner diameter of bands 75 may differ from the initial inner diameter of grab ring 47.

Figure 8:
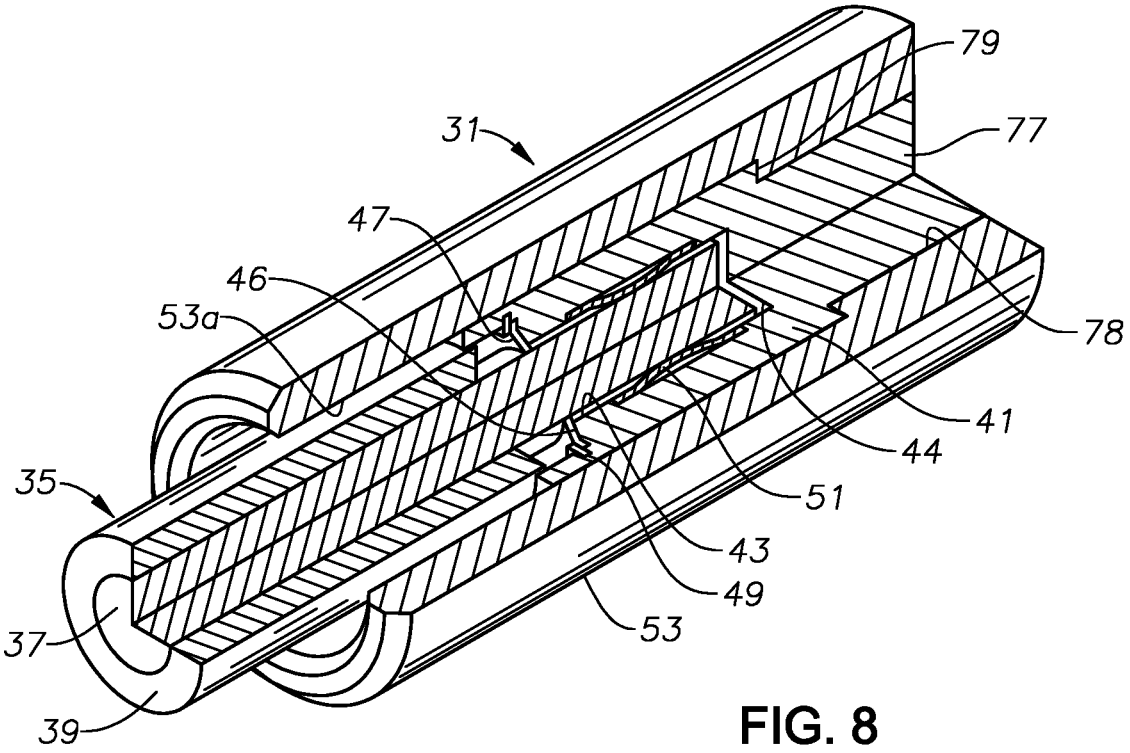
FIG. 8 is a perspective, partially sectioned view of part of the electrical connector of FIG. 3.

FIG. 8 illustrates an electrical connector 31 that connects only one electrical conductor to another, not three connections as shown in FIG. 2. The same reference numbers are employed. Conductor member 41 may have a mid-portion 77 with a smaller outer diameter than its end portions. Mid-portion 77 results in an inward-facing retaining shoulder 79. Insulation sleeve 53 has a mid-portion 78 that fits within the recessed mid-portion 77, retaining insulation sleeve 53 on conductor member 41.

During installation, a technician will connect insulated conductors 35 by stripping back insulation layer 39, then pushing each wire 37 through one of the grab rings 47 and into one of the contact members 51. The technician may then seal the ends of insulation sleeve 53 to insulated conductors 31 by wrapping with tape.

While making the connection, the technician will grip insulation sleeve 53 to avoid contact with wire 37, which could have an electrical charge, particularly if motor 19 is a permanent magnet motor. The length of the protruding portion of wire 37 may be selected such that it will be substantially recessed within protruding end 53*a* of insulation sleeve 53 during insertion before the wire tip reaches contact member 51. Protruding insulation sleeve end 53*a* reduces a chance of inadvertent contact of the protruding portion of wire 37 by the technician; wire 37 could have an electrical charge.

Electrical connector 31 allows a technician to more quickly insulate potentially energized wires, thus reducing exposure time. Electrical connector 31 allows repeated connects and disconnects of a splice without having to cut wires, de-solder, or do other destructive mechanical work. Further if electrical connector 31 is used in a cable splice, it will aid in blocking gas from travelling up the power cable, particularly those with stranded wires 37.

Electrical connector 31 may be used in a variety of places in an ESP 11 assembly in addition to transpositional splices 29. For example, electrical connector 31 could be employed in other types of cable splices, in packer penetrators and within motor 19. A similar electrical connector 31 could be used to connect together the three internal motor wires in a wye configuration of motor 19. Electrical connector 31 would allow repeated connects and disconnects, allowing the wye to be more easily taken apart. This feature would be useful in electrical submersible pump tandem motors, where wyes have to be deconstructed to allow stators normally intended as a bottom motor in a tandem to be used as an upper motor in a tandem. Additionally, electrical connector 31 could be used outside of submersible well pump assemblies for connecting electrical wires to each other in general.

Figure 9:
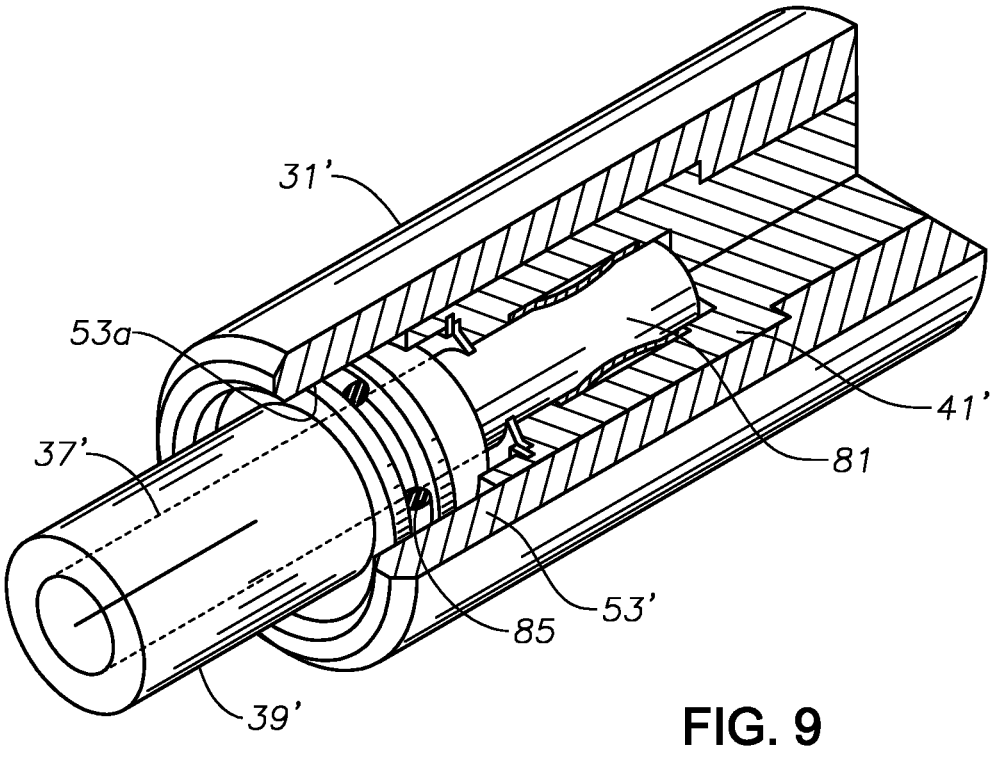
FIG. 9 is a perspective, partially sectioned view of an alternate embodiment of the electrical connector of FIG. 3.

Referring to FIG. 9, the components mentioned below that are the same as in the first embodiment have the same reference numeral with a prime symbol. Components not mentioned are the same as the first embodiment. In this embodiment, conductor wire 37' has a terminal 81 crimped onto it that protrudes from insulation layer 39'. Terminal 81 may be a pin, as shown, or a receptacle, and in either case, it is considered to be an extension of wire 37'. Terminal 81 has an integrally connected annular seal retaining member 83. Seal retaining member 83 has an annular recess containing an elastomeric seal ring 85. Seal ring 85 seals to the inner diameter of protruding portion 53*a*, which extends past an end of conductor member 41'. Seal retaining member 83 and seal ring 85 provide a seal, preventing the entry of well fluid into contact with terminal 81.

Electrical connector 31' could have both ends with a seal retaining member 83 configured as in FIG. 9. Alternately, one of the ends of electrical connector 35' could be configured as in the first embodiment of FIGS. 2-8.

The present disclosure described herein, therefore, is well adapted to carry out the objects and attain the ends and advantages mentioned, as well as others inherent therein. While only two embodiments of the disclosure have been given for purposes of disclosure, numerous changes exist in the details of procedures for accomplishing the desired results. These and other similar modifications will readily suggest themselves to those skilled in the art, and are intended to be encompassed within the scope of the appended claims.

For example, grab rings 47 could be mounted out of contact with conductor member 41, and all of the electrical continuity between wire 37 and conductor member 41 could be achieved through contact member 51. Alternately, all of the electrical continuity between conductor member 41 and wire 37 could be provided by grab ring 47, eliminating the need for contact member 51. Also, the grab ring 47 and contact member 51 on one end could have different inner diameters than the grab ring 47 and contact member 51 on the opposite end to connect different diameters of wires 37 to the opposite ends of electrical connector 35.

The invention claimed is:

1. An electrical connector, comprising:

an electrical conductor member having a longitudinal axis, a first end with a first opening and a second end with a second opening;

first and second grab rings mounted in the first and second openings, respectively, each of the grab rings comprising an annular rim with and a plurality of teeth protruding from an inner diameter of the rim and toward the axis, the teeth having crests defining a superimposed inner diameter for each of the grab rings and the outer portion of each of the teeth of each of the grab rings has a circumferentially extending dimension that is less than the circumferentially extending dimension of each of the crests; where the superimposed inner diameter of the first grab ring is selected to receive a first electrical wire having a larger outer diameter than the superimposed inner diameter of the first grab ring, causing the teeth of the first grab ring to deflect and frictionally engage the outer diameter of the first electrical wire to retain the first electrical wire in the first opening; and the superimposed inner diameter of the second grab ring is selected to receive a second electrical wire having a larger outer diameter than the superimposed inner diameter of the second grab ring, causing the teeth of the second grab ring to deflect and frictionally engage the outer diameter of the second electrical wire to retain the second electrical wire in the second opening.

2. The connector according to claim 1, further comprising:

a sleeve of insulation material around an exterior of the conductor member.

3. The connector according to claim 1, further comprising:

a resilient first electrical contact member in the first opening adjacent the first grab ring, the first electrical contact member having an inner portion and an outer portion, the first electrical contact member configured so that the inner portion is biased into contact with the first electrical wire and the outer portion is biased into contact with the conductor member; and a resilient second electrical contact member in the second opening adjacent the second grab ring, the second electrical contact member having an inner portion and an outer portion, the second electrical contact member configured so that the inner portion is biased into contact with the second electrical wire and the outer portion is biased into contact with the conductor member.

4. The connector according to claim 1, wherein:

the crest of each of the teeth of each of the grab rings has a curvature equal to a curvature of the superimposed inner diameter.

5. The connector according to claim 1, wherein each of the grab rings comprises:

each annular rim having an outer surface that defines the outer diameter of each of the grab rings and wherein each of the teeth of each of the grab rings has an outer portion joining the inner diameter of the annular rim.

6. The connector according to claim 5, wherein:

the teeth of each of the grab rings define a superimposed conical surface of revolution; and the rim of each of the grab rings is located in a plane perpendicular to the axis.

7. The connector according to claim 5, wherein:

the crest of each of the teeth has a curvature with a radius that defines the superimposed inner diameter; and the crest of each of the teeth has a circumferentially extending dimension.

8. The connector according to claim 1, wherein:

each of the grab rings is in electrical contact with the conductor member.

9. The connector according to claim 1, further comprising:

a sleeve of insulation material around an exterior of the conductor member; wherein the sleeve has a first end that protrudes past the first opening of the conductor member to receive an insulation layer of the first wire; and the sleeve has a second end that protrudes past the second opening of the conductor member to receive an insulation layer of the second wire.

10. An electrical connector assembly, comprising:

first and second electrical wires, each having a conductor surrounded by an insulation layer, each of the conductors having an exposed end protruding from the insulation layer;

an electrical conductor member having a first end with a first opening and a second end with a second opening and a longitudinal axis extending through the first and second openings;

first and second grab rings mounted in the first and second openings, respectively, each of the grab rings comprising an annular rim and a plurality of teeth protruding from an inner diameter of the annular rim toward the axis, the teeth of each of the grab rings having crests that frictionally engage and grip the exposed end of the conductor of the first and second electrical wires and the outer portion of each of the teeth of each of the grab rings has a circumferentially extending dimension that is less than the circumferentially extending dimension of each of the crests;

a resilient first electrical contact member in the first opening recessed from the first grab ring, the first electrical contact member an inner portion and an outer portion, the first electrical contact member configured so that the inner portion is biased into contact with the exposed end of the first electrical wire and the outer portion biased into contact with the conductor member;

a resilient second electrical contact member in the second opening recessed from the second grab ring, the second electrical contact member having an inner portion biased into contact with the exposed end of the second electrical wire and an outer portion biased into contact with the conductor member; and a sleeve of insulation material around an exterior of the conductor member, the sleeve having a first end that protrudes past the first opening of the conductor member and receives the insulation layer of the first wire, the sleeve having a second end that protrudes past the second opening of the conductor member and receives the insulation layer of the second wire.

11. The assembly according to claim 10, wherein:

the crest of each of the teeth of the first grab ring has a curvature with a radius extending from the axis that is equal to a radius of the exposed end of the conductor of the first electrical wire; and the crest of each of the teeth of the second grab ring has a curvature with a radius extending from the axis that is equal to a radius of the exposed end of the conductor of the second electrical wire.

12. The assembly according to claim 10, wherein each of the grab rings comprises:

a circular rim having an outer surface that defines an outer diameter of each of the grab rings, the rim of each of the grab rings having an inner diameter; and wherein each of the teeth of each of the grab rings has an outer portion joining the inner diameter of the rim.

13. The assembly according to claim 12, wherein:

the teeth of each of the grab rings define a superimposed conical surface of revolution; and the rim of each of the grab rings is located in a plane perpendicular to the axis.

14. The assembly according to claim 12, wherein:

the crest of each of the teeth of each of the grab rings has a curvature with a radius that is equal to a radius of the exposed end of the conductor of one of the electrical wires;

the crest of each of the teeth of each of the grab rings has a circumferentially extending dimension.

15. The assembly according to claim 10, wherein:

each of the grab rings is in electrical continuity with the conductor member.

16. An electrical connector assembly, comprising:

first and second electrical wires, each having a conductor surrounded by an insulation layer, each of the conductors having an exposed end protruding from the insulation layer;

an electrical conductor member having first and second ends on a longitudinal axis, each of the first and second ends having a bore with a conical wall inclining to a smaller diameter in a recessed direction, each of the bores having a cylindrical bore portion recessed from the conical wall;

first and second grab rings mounted in the bore of the first and second ends, respectively, each of the grab rings having a circular rim located in a plane perpendicular to the axis and a plurality of teeth protruding from the rim toward the axis, the teeth of each of the grab rings having curved crests that frictionally engage and grip the exposed end of the conductor of one of the first and second electrical wires;

the crests defining a conical surface of revolution that inclines in a recessed direction parallel to one of the conical walls;

a resilient first electrical contact member in the cylindrical bore portion of the first end and recessed from the first grab ring, the first electrical contact member having two axially-spaced apart contact ends biased into electrical contact with the cylindrical bore portion of the first end and an inner portion connecting and curving inward from the contact ends into electrical contact with the exposed end of the first electrical wire;

a resilient second electrical contact member in the cylindrical bore portion of the second end and recessed from the second grab ring, the second electrical contact member having two axially-spaced apart contact ends biased into electrical contact with the cylindrical bore portion of the second end and an inner portion connecting and curving inward from the contact ends of the second electrical contact member into electrical contact with the exposed end of the second electrical wire; and a sleeve of insulation material around an exterior of the conductor member, the sleeve having a first sleeve end that protrudes past the bore of the first end of the conductor member and receives the insulation layer of the first wire, the sleeve having a second sleeve end that protrudes past the bore of the second end of the conductor member and receives the insulation layer of the second wire.

17. The connector assembly according to claim 16, wherein each of the grab rings is in electrical contact with the conductor member.

18. The connector assembly according to claim 16, wherein each of the bores has a closed end, the closed ends being axially separated from each other and facing in opposite directions.

19. The connector assembly according to claim 16, wherein the exposed end of the conductor of each of the first and second wires comprises:

a seal retaining member secured around the insulation layer;

an elastomeric seal ring between the seal retaining member and the bore of one of the first and second ends of the conductor member; and a terminal secured to the conductor and protruding in a recessed direction from the seal retaining member, the terminal comprising the exposed end of one of the electrical wires.

20. The connector assembly according to claim 16, wherein the crests of the teeth of each of the grab rings have circumferential dimensions greater than an outer portion of the teeth that joins the rim.

* * * * *